US011759086B2

(12) United States Patent
Terrádez Alemany et al.

(10) Patent No.: US 11,759,086 B2
(45) Date of Patent: Sep. 19, 2023

(54) HOUSEHOLD DISHWASHER MACHINE, SYSTEM COMPRISING HOUSEHOLD DISHWASHER MACHINE, AND METHOD FOR OPERATING A HOUSEHOLD DISHWASHER MACHINE

(71) Applicant: BSH Hausgeräte GmbH, Munich (DE)

(72) Inventors: Maria Terrádez Alemany, Munich (DE); Kai Paintner, Welden (DE); Matthias Heckes, Munich (DE); Daniel Hitzler, Dillingen (DE)

(73) Assignee: BSH Hausgeräte GmbH, Munich (DE)

( * ) Notice: Subject to any disclaimer, the term of this patent is extended or adjusted under 35 U.S.C. 154(b) by 477 days.

(21) Appl. No.: 16/619,103

(22) PCT Filed: Jul. 6, 2018

(86) PCT No.: PCT/EP2018/068332

§ 371 (c)(1),
(2) Date: Dec. 4, 2019

(87) PCT Pub. No.: WO2019/015992

PCT Pub. Date: Jan. 24, 2019

(65) Prior Publication Data

US 2020/0138261 A1 May 7, 2020

(30) Foreign Application Priority Data

Jul. 19, 2017 (DE) ..... 10 2017 212 316.8

(51) Int. Cl.
*A47L 15/00* (2006.01)
*A47L 15/42* (2006.01)
*A47L 15/46* (2006.01)

(52) U.S. Cl.
CPC ..... *A47L 15/0063* (2013.01); *A47L 15/0049* (2013.01); *A47L 15/42* (2013.01);
(Continued)

(58) Field of Classification Search
CPC .. A47L 15/00; A47L 15/0049; A47L 15/0063; A47L 15/42; A47L 15/46; A47L 2401/30; A47L 2501/26
(Continued)

(56) References Cited

U.S. PATENT DOCUMENTS 6,559,882 B1 * 5/2003 Kerchner ..... H05B 6/6435 345/184
7,304,275 B2 * 12/2007 Chun ..... H05B 6/6441 99/325
(Continued)

FOREIGN PATENT DOCUMENTS

CN 103479313 A 1/2014
DE 102011077572 A1 12/2012
(Continued)

OTHER PUBLICATIONS

Clemens et al. (DE 10 2011 087274 A1, Computer Translation by Espacenet as generated on Apr. 9, 2022). (Year: 2022).*
(Continued)

*Primary Examiner* — Duy Vu N Deo
*Assistant Examiner* — Christopher Remavege
(74) *Attorney, Agent, or Firm* — Michael E. Tschupp; Andre Pallapies; Brandon G. Braun

(57) ABSTRACT

A household dishwasher includes a washing compartment, an activatable unit arranged in the washing compartment, a control device configured to actuate the activatable unit, an optical sensor configured to acquire an optical sensor signal of the washing compartment, and a communication unit for bidirectional communication with a remote server. The communication unit transmits the acquired optical sensor signal to the remote server and receives a control command
(Continued)

from the remote server for actuating the activatable unit and to forward the received control command to the control device.

12 Claims, 4 Drawing Sheets

(52) U.S. Cl.
CPC ..... *A47L 15/46* (2013.01); *A47L 2401/30* (2013.01); *A47L 2501/26* (2013.01)

(58) Field of Classification Search
USPC ..... 134/18, 56 R, 57 R, 57 D, 56 D, 58 R
See application file for complete search history.

(56) References Cited

U.S. PATENT DOCUMENTS

| | | | | |
|---|---|---|---|---|
| 7,935,194 | B2 * | 5/2011 | Rolek | A47L 15/0018 134/58 D |
| 8,229,161 | B2 * | 7/2012 | Hudnut | A47L 15/4293 382/181 |
| 8,509,473 | B2 * | 8/2013 | Wagner | D06F 34/18 382/100 |
| 9,264,252 | B2 | 2/2016 | Ebrom | |
| 10,004,375 | B2 * | 6/2018 | Heidel | A47L 15/4221 |
| 10,012,971 | B2 * | 7/2018 | Pietsch | G05B 19/048 |
| 10,117,294 | B2 * | 10/2018 | Beifuss | H04N 5/2257 |
| 11,125,736 | B2 * | 9/2021 | Kessler | H04N 13/204 |
| 2009/0056754 | A1 * | 3/2009 | Rolek | A47L 15/4295 134/18 |
| 2010/0294311 | A1 * | 11/2010 | Classen | A47L 15/4295 134/18 |
| 2011/0017235 | A1 * | 1/2011 | Berner | A47L 15/4234 134/18 |
| 2011/0056520 | A1 * | 3/2011 | Varacins | A47L 15/0049 134/18 |
| 2012/0060875 | A1 * | 3/2012 | Fauth | A47L 15/46 134/56 D |
| 2013/0032171 | A1 * | 2/2013 | Heidel | A47L 15/0049 134/10 |
| 2013/0171023 | A1 * | 7/2013 | Ben-Shmuel | A47L 15/42 134/115 R |
| 2013/0220374 | A1 * | 8/2013 | Heidel | A47L 15/0049 134/18 |
| 2014/0048139 | A1 * | 2/2014 | Fisher | A47L 15/4297 137/386 |
| 2014/0069462 | A1 * | 3/2014 | Becker | A47L 15/4219 134/10 |
| 2016/0231723 | A1 | 8/2016 | Pietsch et al. | |
| 2017/0188416 | A1 * | 6/2017 | Beifuss | H05B 6/766 |
| 2017/0202426 | A1 * | 7/2017 | Bosen | A47L 15/23 |

FOREIGN PATENT DOCUMENTS

| | | | | |
|---|---|---|---|---|
| DE | 102011087274 | A1 * | 5/2013 | A47L 15/0021 |
| DE | 102011087274 | A1 | 5/2013 | |
| DE | 212014000095 | U1 | 10/2015 | |
| DE | 212014000095 | U1 * | 12/2015 | F25D 27/005 |
| DE | 102015102694 | A1 * | 8/2016 | |
| DE | 102016101790 | A1 * | 8/2017 | A47L 15/0063 |
| EP | 2879100 | A1 | 6/2015 | |
| WO | 2009138359 | A2 | 11/2009 | |
| WO | WO-2016096020 | A1 * | 6/2016 | A47L 15/22 |

OTHER PUBLICATIONS

DE-102015102694-A1, Kornberger M, Machine Translation. (Year: 2023).*
DE-102016101790-A1, Lehmann, Machine Translation. (Year: 2023).*
National Search Report DE 10 2017 212 316.8 dated May 23, 2018.
International Search Report PCT/EP2018/068332 dated Oct. 22, 2018.
National Search Report CN 2018800481169 dated Jul. 28, 2022.

* cited by examiner

HOUSEHOLD DISHWASHER MACHINE, SYSTEM COMPRISING HOUSEHOLD DISHWASHER MACHINE, AND METHOD FOR OPERATING A HOUSEHOLD DISHWASHER MACHINE

CROSS-REFERENCES TO RELATED APPLICATIONS

This application is the U.S. National Stage of International Application No. PCT/EP2018/068332, filed Jul. 6, 2018, which designated the United States and has been published as International Publication No. WO 2019/015992 A1 and which claims the priority of German Patent Application, Ser. No. 10 2017 212 316.8, filed Jul. 19, 2017, pursuant to 35 U.S.C. 119(a)-(d).

BACKGROUND OF THE INVENTION

The present invention relates to a household dishwasher, a system comprising a household dishwasher, and a server and a method for operating a household dishwasher.

Conventional household dishwashers have for example a display on which a fault code is displayed if the dishwasher detects a problem. For some of these fault codes, there are for example hints on how to resolve the problem in the dishwasher manual, which a user of the dishwasher can follow himself or herself. Some problems, however, are more complex so that the customer service must be called. It also occurs that the cleaning performance of the dishwasher is impaired without the dishwasher detecting a problem. In this case, too, the user turns for example to the customer service for the latter to resolve the problem.

In such a case, the customer service will in particular visit the user at home in order to be able to inspect the dishwasher and for example to perform various tests. This is time-consuming, inconvenient and costly. For example, the user must be at home for the appointment in order to provide the customer service with access to the dishwasher. Moreover, it occurs that a problem cannot be resolved immediately because special spare parts are required for this purpose, for example. This can for example necessitate another customer service visit at a later time, which can incur further delay and further costs.

WO 2009/138359 describes a household appliance with an image acquisition device, with which an image of an interior of the household appliance can be acquired, which can be made available for a user on a display on the exterior of the household appliance.

BRIEF SUMMARY OF THE INVENTION

Against this background, an object of the present invention consists in creating an improved household dishwasher.

According to a first aspect, a household dishwasher with a control device for actuating an activatable unit arranged in a washing compartment, a communication unit for bidirectional communication with a remote server, and an optical sensor for acquiring an optical sensor signal of the washing compartment is proposed. The communication unit is configured to transmit the acquired optical sensor signal to the remote server, to receive a control command for actuating the activatable unit from the remote server, and to forward the received control command to the control device, where appropriate in preprocessed or processed form.

With this household dishwasher, it is advantageously possible to enable the washing compartment of the household dishwasher to be inspected from a remote position, to enable the household dishwasher to be controlled remotely by the server and/or by the customer service, and to enable a result of a control command to be observed directly. In this way, technical problems of a household dishwasher can be identified prior to a customer service visit and, if a repair is required, preparations can be made such that only one customer service visit to a user of the household dishwasher is necessary for this purpose. Alternatively, in the event of minor problems, the user can be given direct instructions as to how he/she can rectify the problem himself/herself under the guidance of the customer service.

Customer service is also understood to mean for example computer-based help programs that provide the user with a step-by-step guide to rectifying known problems that the user can rectify himself/herself.

The control device can be implemented as hardware or software. If implemented as hardware, the control device can be embodied for example as a computer or microprocessor. If implemented as software, the control device can be embodied as a computer program product, as a function, as a routine, as part of a program code or as an executable object. The control device is configured in particular as a central control device for the household dishwasher.

The household dishwasher has at least one activatable unit. The activatable unit comprises for example a circulating pump, a drain pump, a valve for a water supply, an electrically driven spray arm, an automatic door opening unit, an automatic door closing unit, an automatically movable receptacle for items to be washed, in particular a lifting device for a receptacle for items to be washed, an automatic dosing system, a display element, the communication unit, the optical sensor and/or a lighting device.

The control device is preferably configured to actuate each activatable unit of the household dishwasher individually and independently of further activatable units. Actuate is understood to mean for example that the activatable unit is activated such that it carries out a predetermined action. If the activatable unit has different predetermined functions, the control device is preferably configured to actuate each of the predetermined functions individually.

The communication unit is preferably configured for bidirectional communication with a remote server. This means that the communication unit can both transmit data to the server and receive data from the server. The communication unit can in particular also be configured for bidirectional communication with further external devices, such as a mobile device of a user. Here, the communication unit can also communicate with multiple devices in parallel. The communication unit is embodied in particular as a modem and/or a network adapter. The transmission and/or receipt of data can take place via a wired network, such as LAN (Local Area Network), Firewire (IEEE 1394), USB (Universal Serial Bus), and/or via a wireless network, such as WLAN (Wireless Local Area Network), Bluetooth, NFC (Near Field Communication), ZigBee, in particular a mobile radio network. Data is understood to mean in particular messages in the form of digital signals.

The remote server is for example a server which is operated by the manufacturer of the household appliance and is accessible via the Internet from all over the world. The server has in particular a permanently assigned URL (Uniform Resource Locator) or URI (Uniform Resource Identifier), so that the Internet address of the server is fixed and the server is always accessible via it.

The optical sensor is in particular embodied as an optoelectronic sensor, which makes an analog electrical signal available as the optical sensor signal as a function of an optical signal. This offers the advantage that the optical sensor is integrated on a microchip and can therefore be manufactured and used in a manner which saves on space and material and is cost-effective. Moreover, the analog electrical signal can be converted into a digital signal with little outlay, for example by means of an A/D converter, and then processed digitally.

The optical sensor is in particular arranged in the household dishwasher such that it acquires an optical sensor signal of the washing compartment. This is achieved for example if there is a line of sight from the optical sensor to the washing compartment. Advantageously, the optical sensor is positioned such that it acquires for example the entire washing compartment and thus all activatable units arranged within the washing compartment. The optical sensor signal is advantageously not limited to the washing compartment. When the door of the household dishwasher is open, the optical sensor signal can also cover a region in front of the washing compartment, in particular the region in which a receptacle for items to be washed is movable.

By the optical sensor acquiring an optical sensor signal of the washing compartment, it is in particular also possible to acquire effects of the activatable units in the washing compartment which are not visible, such as a circulating pump.

The optical sensor is arranged for example on the ceiling of the washing compartment, on the rear wall of the washing compartment and/or on a door of the household dishwasher, which in the closed state forms the washing compartment in conjunction with the dishwasher cavity. It can further be provided for multiple optical sensors to be used, wherein each of the optical sensors in each case acquires an optical sensor signal of a respective region of the washing compartment which is assigned to the respective optical sensor.

The optical sensor is in particular configured to acquire the optical sensor signal over a broad spectral range, which is not limited to the optical spectral range.

The optical sensor comprises for example a camera, in particular a digital camera, for example with a CCD sensor (CCD: Charged Coupled Device). The camera acquires for example an image and/or an image sequence of the component.

In embodiments of the household dishwasher, it can be provided that the user acquires a further optical sensor signal of the washing compartment or of a section of the washing compartment by means of an optical sensor integrated in a mobile device, in particular a camera of a smartphone, which optical sensor signal is transmitted to the remote server directly from the mobile device or alternatively by means of the communication unit of the household dishwasher. This additional optical signal can be helpful in particular in the case of a position in the washing compartment which is difficult to view with the optical sensor or for a detailed view.

A lighting device which illuminates the washing compartment can be provided by way of support. This lighting device can in particular be embodied as a narrowband light source, such as a laser. Alternatively, the lighting device can be embodied as a broadband light source, such as a light bulb and/or a flash unit.

The communication unit is configured to transmit the optical sensor signal acquired by the optical sensor to the remote server. To this end, the communication unit establishes a communication connection to the server, in particular via the Internet. It can also be provided that the server takes the initiative to establish the communication connection, for example by means of a WOL signal (Wake On LAN). The communication unit can also be configured to transmit further status parameters of the household dishwasher to the server in addition to the acquired optical sensor signal. A comprehensive data record of the household dishwasher is then transmitted to the server, thus enabling a thorough check of all functions of the household dishwasher which are accessible via the status parameters.

The server receives the optical sensor signal. The server is configured for example to process and/or analyze the optical sensor signal. The server can be configured to identify a malfunction and/or a deviation from a normal status of the household dishwasher as a function of the transmitted optical sensor signal. The server is in particular configured to provide the transmitted optical sensor signal to a display device. This display device is for example attended by a customer service staff member, who can visually check the transmitted optical sensor signal.

The server is configured to transmit a control command to the household dishwasher. The control command can be a control command which is generated automatically as a function of the transmitted optical sensor signal and/or an identified malfunction of the household dishwasher. The control command can in particular also be a control command which is generated by a customer service staff member. The control command can be understood as a remote control of the household dishwasher.

The control command can be any command capable of being executed by the control device. Here, a number of possible commands depends on the embodiment of the household dishwasher. In particular, the control command can also comprise just an "Everything OK" indicating to the control device that there is no malfunction.

The acquisition of the optical sensor signal and the remote control of the household dishwasher thus make it possible to check an operating capability of activatable units of the household dishwasher and/or of the household dishwasher as a whole. Here, an effect of an actuation of the activatable unit can be checked directly and visually.

This also makes it possible to ascertain problems which are unconnected with the function of an activatable unit. For example, a heavy soiling can result in the blockage of a filter. As a result of water being supplied and the circulating pump being activated, it is possible for example to observe the outflow speed of the water through the filter. If the filter has a below-average outflow speed, it is possible for example to start a machine cleaning program or to instruct the user to clean the blocked filter manually.

Overall, the proposed household dishwasher offers a wide variety of possibilities for cutting costs and for resolving technical problems with the household dishwasher in a user-friendly and efficient manner.

According to one embodiment of the household dishwasher, the communication unit is configured to receive the control command from the remote server as a response to the transmitted optical sensor signal.

According to a further embodiment of the household dishwasher, the latter is configured to acquire the optical sensor signal as a function of a request of the server and to transmit the acquired optical sensor signal to the server.

The request of the server corresponds in particular to a control command for acquiring the optical sensor signal. In this embodiment, the server for example initiates the establishment of a communication connection. This can be particularly convenient for a user, who does not then need to concern himself/herself with establishing the connection.

According to a further embodiment, the household dishwasher has a lighting device for illuminating the washing compartment during acquisition of the optical sensor signal.

This embodiment is particularly advantageous in that it enables an optical signal to be acquired with a good signal-to-noise ratio even when the door of the household dishwasher is closed. In particular, the washing compartment of the household dishwasher can in this way be observed by means of the optical sensor even while a wash program is being carried out.

According to a further embodiment of the household dishwasher, the optical sensor comprises a camera, wherein the optical sensor signal comprises an image and/or a video of the washing compartment.

The embodiment in which a video is transmitted to the server is particularly suitable for observing a direct effect of a control command. For example, the optical sensor signal is transmitted to the server as a video signal in a live stream, in other words with no or with only a slight time delay.

According to a further embodiment of the household dishwasher, the activatable unit comprises a circulating pump, a drain pump, a spray arm, a valve, the lighting device, the optical sensor, an automatic dosing system, a door opener, a door closer, a display element and/or a washing basket movement device.

In embodiments of the household dishwasher, it can be provided that the user initiates the establishment of a connection to the server and/or monitors the remote maintenance by means of a user interface on the household dishwasher, for example a display element with an input facility such as a touchscreen and/or a keyboard. It can further be provided that the user monitors the remote maintenance by means of a mobile device, in particular a smartphone, which is connected communicatively with the household dishwasher.

Here, the user can also provide assistance in a supporting capacity. For example, it can be provided that the user manually carries out various operating steps which cannot be carried out automatically, such as an opening and/or closing of the door of the household dishwasher, wherein the instructions provided to the user are output via the user interface. Furthermore, the user can for example transmit an additional optical sensor signal to the server by means of a camera integrated in the smartphone, in order for example to acquire a detailed section of the household dishwasher.

According to a second aspect, a system with a household dishwasher according to the first aspect and a server is proposed. The household dishwasher and the server are configured for communication via a data network. The server is configured to process an optical sensor signal received from the communication unit of the household dishwasher and to transmit a control command to the household dishwasher.

This system advantageously enables a remote maintenance of the household dishwasher and/or a remote help for the user of a household dishwasher to be provided via the data network.

The embodiments and features described in connection with the first aspect apply correspondingly to the proposed system.

According to one embodiment of the system, the server is configured to transmit the control command to the household dishwasher as a response to the transmitted optical sensor signal.

According to a further embodiment of the system, the processing of the optical sensor signal comprises a provision of the optical sensor signal to a display device connected to the server.

The display device is embodied in particular as a screen, a mobile device such as a smartphone, a tablet and/or a screen of a laptop.

According to a further embodiment of the system, the server is configured to identify a property of the household dishwasher as a function of the transmitted optical sensor signal and to transmit the control command to the household dishwasher as a function of the identified property.

The property of the household dishwasher is in particular an operating capability of one or more activatable units and/or also passive units of the household dishwasher.

A filter, for example, is a passive unit of the household dishwasher.

According to a third aspect, a method for operating a household dishwasher with a control device for actuating an activatable unit arranged in a washing compartment of the household dishwasher is proposed. In a first method step, an optical sensor signal of the washing compartment is acquired by means of an optical sensor. In a second method step, the acquired optical sensor signal is transmitted to a remote server by means of a communication unit. In a third method step, a control command is transmitted from the remote server by means of the communication unit to actuate the activatable unit in the washing compartment. In a fourth method step, the activatable unit is actuated by the control device.

This method advantageously makes it possible for the operating capability of the household dishwasher to be established by way of remote maintenance by a customer service and/or for existing problems to be ascertained without the need for a customer service visit so that such a problem can be rectified with only one customer service visit.

The embodiments and features described for the proposed household dishwasher apply correspondingly to the proposed method.

Furthermore, a computer program product is proposed which initiates the execution of the method as described above on a program-controlled device.

A computer program product, such as a computer program means, can for example be provided or supplied as a storage medium such as a memory card, USB stick, CD-ROM or DVD or also in the form of files which can be downloaded from a server in a network. This can take place, for example, in a wireless communications network through the transmission of a corresponding file with the computer program product or the computer program means.

Further possible implementations of the invention also comprise combinations—not explicitly cited—of features or forms of embodiment described above or below in respect of the exemplary embodiments. Here the person skilled in the art will also add individual aspects as improvements or amendments to the respective basic form of the invention.

BRIEF DESCRIPTION OF THE DRAWINGS

Further advantageous embodiments and aspects of the invention are the subject matter of the dependent claims as well as the exemplary embodiments of the invention described below. The invention is described below in greater detail on the basis of preferred forms of embodiment with reference to the attached figures.

DETAILED DESCRIPTION OF EXEMPLARY EMBODIMENTS OF THE PRESENT INVENTION

Figure 1:
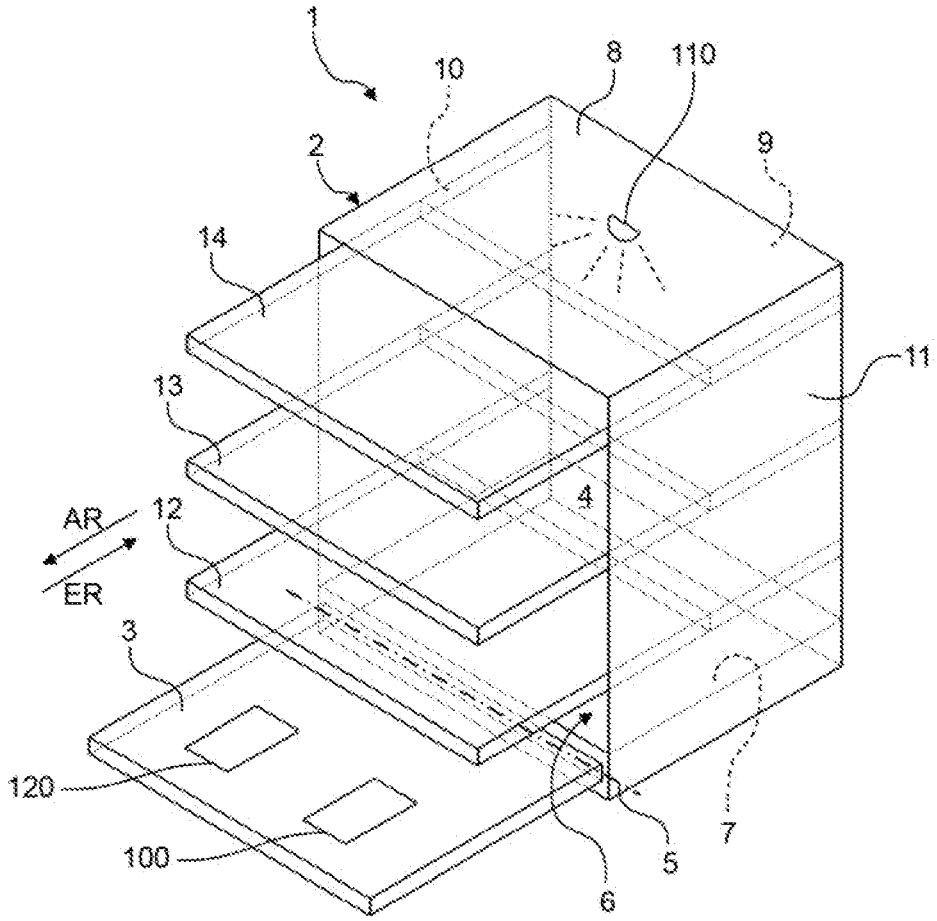
FIG. 1 shows a schematic perspective view of an exemplary embodiment of a household dishwasher.

In the figures, elements that are identical or have the same function are denoted by the same reference characters unless otherwise stated.

FIG. 1 shows a schematic perspective view of an exemplary embodiment of a household dishwasher 1. The household dishwasher 1 has a dishwasher cavity 2, which can be closed by a door 3, in particular in a watertight manner. A sealing facility can be provided for this purpose between the door 3 and the dishwasher cavity 2 (not shown). The dishwasher cavity 2 is preferably cuboid in shape. The dishwasher cavity 2 can be arranged in a housing of the household dishwasher 1. The dishwasher cavity 2 and the door 3 can form a washing compartment 4 for washing items to be washed.

The door 3 is shown in its open position in FIG. 1. The door 3 can be closed or opened by pivoting about a pivot axis 5 provided at a lower end of the door 3. With the aid of the door 3, a loading opening 6 of the dishwasher cavity 2 can be closed or opened. The dishwasher cavity 2 has a base 7, a ceiling 8 arranged opposite to the base 7, a rear wall 9 arranged facing the closed door 3 and two side walls 10, 11 arranged facing one another. The base 7, the ceiling 8, the rear wall 9 and the side walls 10, 11 may be manufactured from a stainless steel sheet for example. Alternatively, the base 7 may be manufactured from a plastic material.

Furthermore, the household dishwasher 1 has at least one receptacle for items to be washed 12, 13, 14. Preferably, a plurality of receptacles for items to be washed 12, 13, 14, for example three, are provided, wherein the receptacle for items to be washed 12 may be a lower receptacle for items to be washed or a lower basket, the receptacle for items to be washed 13 may be an upper receptacle for items to be washed or an upper basket, and the receptacle for items to be washed 14 may be a cutlery drawer. As additionally shown in FIG. 1, the receptacles for items to be washed 12, 13, 14 are arranged above one another in the dishwasher cavity 2. Each receptacle for items to be washed 12 to 14 is optionally able to be shifted into or out of the dishwasher cavity 2. In particular, each receptacle for items to be washed 12, 13, 14 is able be inserted into the dishwasher cavity 2 in an insertion direction ER and extracted from the dishwasher cavity 2 in an extraction direction AR opposite to the insertion direction ER.

The household dishwasher 1 also has a control device 100 and a communication unit 120, which are arranged on the door 3. An optical sensor 110 embodied as a camera is arranged on the ceiling 8 such that it is configured to acquire an optical sensor signal A (see FIG. 2 or FIG. 3) of the washing compartment 4. The dashed lines below the camera 110 indicate an acquisition region of the camera 110. The communication unit 120 is configured to transmit the acquired optical sensor signal A to a remote server 200 (see FIG. 2 or FIG. 3) and to receive a control command B (see FIG. 2 or FIG. 3) therefrom.

On account of the combination of the camera 110 and the communication unit 120, it is advantageously possible to perform remote maintenance and/or remote diagnostics for the household dishwasher 1. This is explained in more detail below with reference to FIG. 2 and FIG. 3.

Figure 2:
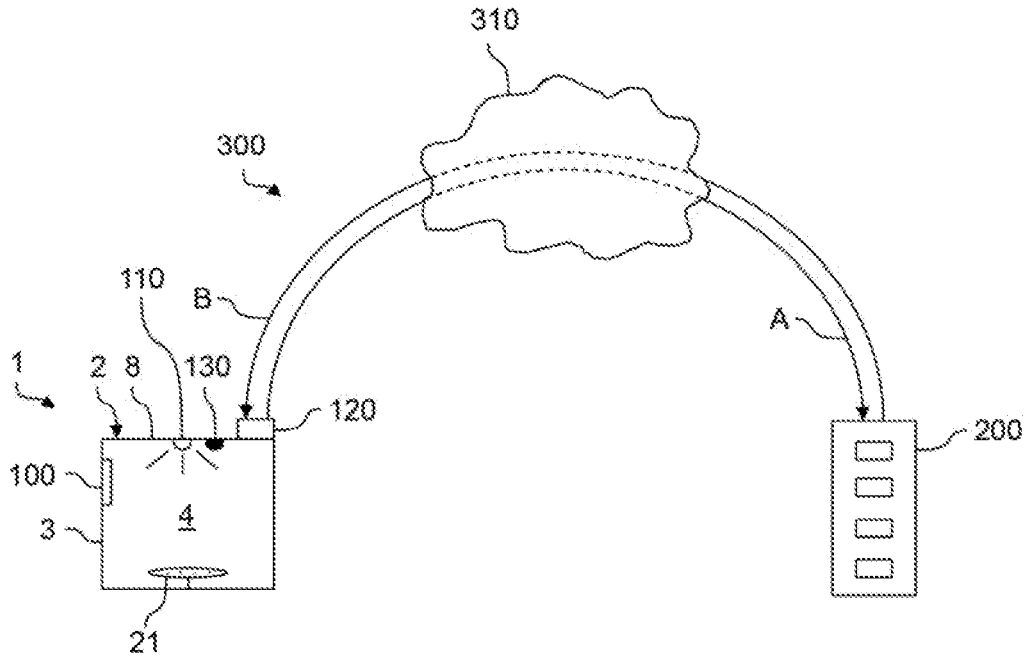
FIG. 2 shows a schematic view of an exemplary embodiment of a system with a household dishwasher and a server.

FIG. 2 shows a schematic view of an exemplary embodiment of a system 300 with a household dishwasher 1 and a server 200. The household dishwasher 1 is for example a variant of the household dishwasher 1 shown in FIG. 1. The communication unit 120 of the household dishwasher 1 and the server 200 are connected communicatively with one another by way of a data network 310. The data network 310 is for example the Internet and the communication connection is based on HTTP and/or on FTP. Further, proprietary connection protocols are also possible alternatively or additionally.

The household dishwasher 1 has an activatable unit 21, which is embodied here as a spray arm. In addition to the control device 100 and the optical sensor 110, which is embodied as a camera, the household dishwasher also has a lighting device 130, which is embodied here as a broadband light source for illuminating the washing compartment 4. The lighting device 130 thus also illuminates the spray arm 21. As a result, the camera 110 can acquire a high-quality, detailed optical sensor signal A, here an image, of the washing compartment 4 and the spray arm 21.

There is for example an apparent problem with the spray arm 21 of the household dishwasher 1. The user of the household dishwasher reports this to the customer service and/or reports the problem to the server 200. Thereupon it is provided for example that the server 200 contacts the household dishwasher 1, in particular via the Internet 310, whereupon the communication unit 120 establishes the communication connection to the server 200. The server 200 now transmits for example a first control command B, which in this case causes the control device 100 to actuate the light source 130 for illuminating the washing compartment 4 and the spray arm 21 as well as the camera 110 for acquiring the image A. The acquired image A is then transmitted from the communication unit 120 via the Internet to the server 200.

The server evaluates the received image A and thereupon transmits a further control command B, which this time additionally comprises an activation of the spray arm 21. By a further image A being acquired and transmitted to the server 200 after or during activation of the spray arm 21, the server 200 can identify for example by comparing the images A whether the spray arm 21 is working properly.

If the server 200 identifies that the spray arm 21 is not working properly, further control commands B can be provided in order to identify a corresponding cause. It can further be provided to guide the user to perform specific manual steps.

Figure 3:
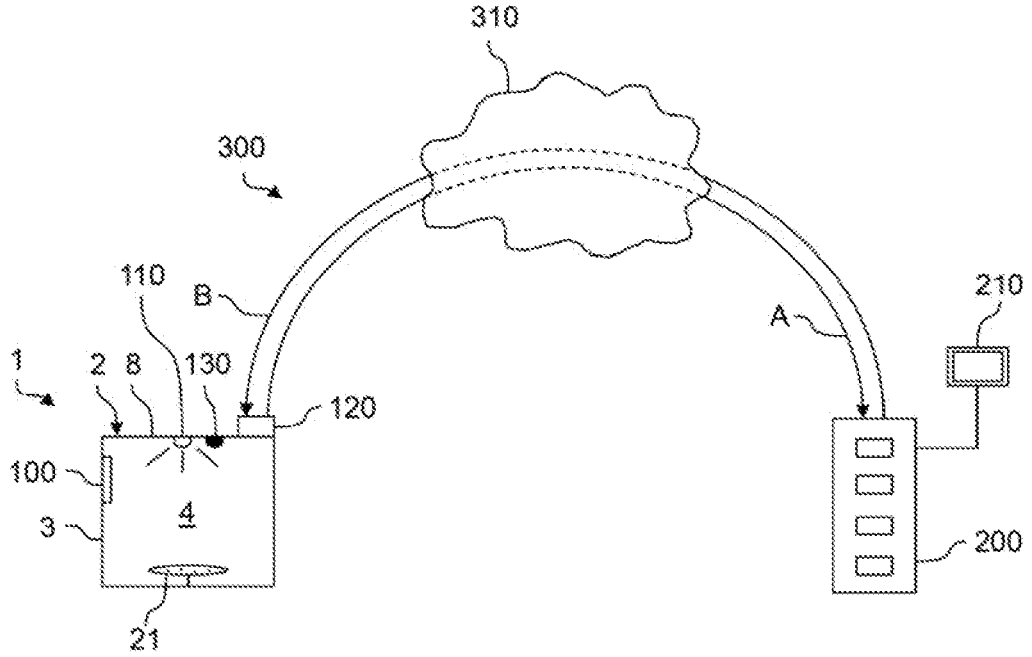
FIG. 3 shows a schematic view of a further exemplary embodiment of a system with a household dishwasher and a server.

FIG. 3 shows a schematic view of a further exemplary embodiment of a system 300 with a household dishwasher 1, in particular a variant of the household dishwasher 1 from FIG. 1 or FIG. 2, and a server 200. The system 300 has the features of the system 300 shown in FIG. 2. In addition, a display device 210 embodied as a screen is connected to the server 200.

In this variant of the system 300, it is in particular possible for an employee of a customer service for the household dishwasher 1 to check the optical sensor signal A transmitted to the server 200 and to transmit a control command B to the household dishwasher 1. In this embodiment, the system 300 is thus protected against a misinterpretation of the image A by the server 200. In particular, an employee can respond flexibly to a status of the household dishwasher 1 and also identify and resolve complex malfunctions.

Figure 4:
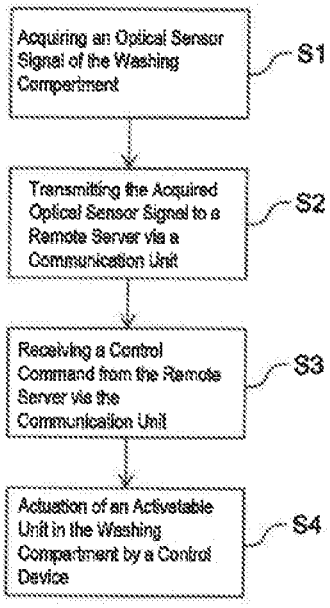
FIG. 4 shows a schematic block diagram of an exemplary embodiment of a method for operating a household dishwasher.

FIG. 4 shows a schematic block diagram of an exemplary embodiment of a method for operating a household dishwasher 1, in particular the household dishwasher 1 from FIG. 1, FIG. 2 or FIG. 3.

In a first method step S1, an optical sensor signal A of the washing compartment 4 is acquired by means of an optical sensor 110.

In a second method step S2, the acquired optical sensor signal A is transmitted to a remote server 200 by means of a communication unit 120 of the household dishwasher 1.

In a third method step S3, a control command B is received from the remote server 200 by means of the communication unit 120 to actuate the activatable unit 21 in the washing compartment 4.

In a fourth method step S4, the activatable unit 21 is actuated by the control device 100. The actuation takes place in particular as a function of the received control command B.

Although the present invention has been described with reference to exemplary embodiments, it can be modified in numerous different ways.

The invention claimed is:

1. A household dishwasher, comprising:

a washing compartment;

an activatable unit arranged in the washing compartment;

a control device configured to actuate the activatable unit;

an optical sensor configured to acquire an optical sensor signal of the washing compartment; and a communication unit for bidirectional communication with a remote server, said communication unit configured to:

transmit the acquired optical sensor signal to the remote server, the remote server being configured to identify a malfunction of the household dishwasher based on the optical sensor signal and determine an actuation of the activatable unit based on the malfunction;

in response to transmitting the acquired optical sensor signal to the remote server, receive a control command from the remote server for causing the activatable unit to perform the actuation; and forward the received control command to the control device.

2. The household dishwasher of claim 1, wherein the communication unit is configured to receive the control command from the remote server as a response to the transmitted optical sensor signal.

3. The household dishwasher of claim 1, wherein the optical sensor is configured to acquire the optical sensor signal as a function of a request of the remote server and to transmit the acquired optical sensor signal to the remote server.

4. The household dishwasher of claim 1, further comprising a lighting device for illuminating the washing compartment during acquisition of the optical sensor signal.

5. The household dishwasher of claim 1, wherein the optical sensor comprises a camera, with the optical sensor signal comprising an image and/or a video of the washing compartment.

6. The household dishwasher of claim 1, wherein the activatable unit comprises a member selected from the group consisting of a circulating pump, a drain pump, a spray arm, a valve, a lighting device, the optical sensor, an automatic dosing system, a door opener, a door closer, a display element, a washing basket movement device, and any combination thereof.

7. A system, comprising:

a household dishwasher comprising a washing compartment, an activatable unit arranged in the washing compartment, a control device configured to actuate the activatable unit, an optical sensor configured to acquire an optical sensor signal of the washing compartment, and a communication unit for bidirectional communication with a remote server, said communication unit configured to transmit the acquired optical sensor signal to the remote server and to receive a control command from the remote server for actuating the activatable unit in response to transmitting the acquired optical sensor signal to the remote server and to forward the received control command to the control device;

the remote server configured to identify a malfunction of the household dishwasher based on processing the optical sensor signal received from the communication unit of the household dishwasher, to determine an actuation of the activatable unit based on the malfunction, and to transmit the control command to the household dishwasher for causing the activatable unit to perform the actuation; and a data network via which the household dishwasher and the remote server are configured to communicate.

8. The system of claim 7, wherein the remote server is configured to transmit the control command to the household dishwasher as a response to the transmitted optical sensor signal.

9. The system of claim 7, further comprising a display device connected to the remote server to display the optical sensor signal.

10. The system of claim 7, wherein the remote server is configured to identify a property of the household dishwasher as a function of the transmitted optical sensor signal and to transmit the control command to the household dishwasher as a function of the identified property.

11. A method for operating a household dishwasher, said method comprising:

acquiring, by an optical sensor, an optical sensor signal of a washing compartment of the household dishwasher;

transmitting, by a communication unit, the acquired optical sensor signal to a remote server, the remote server being configured to identify a malfunction of the household dishwasher based on the optical sensor signal and determine an actuation of an activatable unit in the washing compartment based on the malfunction;

in response to transmitting the acquired optical sensor signal to the remote server, receiving a control command from the remote server by the communication unit; and causing, by a control device, the activatable unit in the washing compartment to perform the actuation in response to receiving the control command.

12. A computer program product for operating a household dishwasher, comprising a program-controlled device having stored therein a computer program embodied in a non-transitory computer readable medium, wherein the computer program, when loaded into the program-controlled device and executed by the program-controlled device, causes the program-controlled device to execute the steps of:

acquiring by an optical sensor an optical sensor signal of a washing compartment of the household dishwasher;

transmitting by a communication unit the acquired optical sensor signal to a remote server, the remote server being configured to identify a malfunction of the household dishwasher based on the optical sensor signal and determine an actuation of an activatable unit in the washing compartment based on the malfunction;

in response to transmitting the acquired optical sensor signal to the remote server, receiving a control command from the remote server by the communication unit; and causing, by a control device, the activatable unit in the washing compartment to perform the actuation in response to receiving the control command.

* * * * *